United States Patent [19]

Merten et al.

[11] 4,332,421

[45] Jun. 1, 1982

[54] COUPLING DEVICES FOR CONNECTING A MINERAL MINING MACHINE TO A DRIVE CHAIN

[75] Inventors: Gerhard Merten, Lünen; Oswald Breuer, Dortmund-Husen; Bernd Steinkuhl, Lünen, all of Fed. Rep. of Germany

[73] Assignee: Gewerkschaft Eisenhutte Westfalia, Lünen, Fed. Rep. of Germany

[21] Appl. No.: 125,933

[22] Filed: Mar. 3, 1980

[30] Foreign Application Priority Data

Mar. 7, 1979 [DE] Fed. Rep. of Germany ..... 2908828

[51] Int. Cl.[3] ..... E21C 35/08; E21C 27/34

[52] U.S. Cl. ..... 299/34; 299/43; 104/280

[58] Field of Search ..... 299/43, 34; 104/280

[56] References Cited

U.S. PATENT DOCUMENTS

| | | | |
|---|---|---|---|
| 323,593 | 8/1885 | Orvis et al. | 104/280 X |
| 821,863 | 5/1906 | Derr | 104/280 X |
| 2,823,908 | 2/1958 | Rosler | 299/34 |
| 3,726,564 | 4/1973 | Hauschopp et al. | 299/34 |
| 4,006,937 | 2/1977 | Curtis | 299/43 |
| 4,234,234 | 11/1980 | Sedlaczek et al. | 299/43 |

*Primary Examiner*—Ernest R. Purser

*Attorney, Agent, or Firm*—Thompson, Birch, Gauthier & Samuels

[57] ABSTRACT

A coupling device for connecting a mineral mining machine, such as a plough, to a drive chain. The coupling device is intended to locate within a channel inside a slotted guide containing the drive chain. The device is composed of coaxial tubular members secured together axially. The inner tubular member supports a swivel-mounted shackle connecting with the chain and a rigidly-mounted shackle connecting with the machine. One or both tubular members are shaped or relieved at the end nearest the swivel shackle to provide a cleaning nose which forces dust or the like from the channel as the chain draws the machine along the guide. A lateral projection on the outer tubular member engages in the slot and co-operates with the nose to guide the material away through the slot.

12 Claims, 2 Drawing Figures

COUPLING DEVICES FOR CONNECTING A MINERAL MINING MACHINE TO A DRIVE CHAIN

BACKGROUND TO THE INVENTION

The present invention relates to a coupling device for connecting a drive chain to a mineral mining machine, particularly but not solely to a plough.

As is well known in longwall mineral, e.g. coal, face workings, a machine such as a plough or shearer is driven back and forth along a guide at the mineral face side of a conveyor to win mineral. A chain is circulated within guide passages or channels inside the guide and the chain is connected to the machine inside one of these guide channels with simple fixed shackles or the like. It is, however, preferable to connect the chain to the machine with the aid of a coupling device permitting a certain amount of free swivelling motion. A coupling device of this kind is described in German Patent specification No. 2438651. This known coupling device has a casing in which a shackle or drawbar is rotatably supported. The drawbar is then fitted to the machine via a hook while the casing is fitted to the chain. Two such coupling devices would be used to connect the machine to the ends of the drive chain and the swivelling drawbars permit the chain to untwist itself thereby ensuring the chain runs onto the associated drive means in the correct position without its links becoming misaligned. The coupling devices run along the guide channel during use. Loose debris, especially fine coal dust, is apt to find its way into the guide passage and can cause jamming or blockage especially since the coupling devices themselves are of greater size than the chain links and simple shackles and tend to push the dust against the wall of the chain guide passages. After repeated runs, the material tends to compact and accumulate and adheres to the wall of the guide passage thus aggravating the problem.

A general object of the present invention is to provide an improved form of coupling device.

SUMMARY OF THE INVENTION

A coupling device constructed in accordance with the invention comprises a casing provided with shackle means for connection both to a drive chain and a mineral mining machine to allow swivelling. The device has a shaped region at the end adjacent the chain which serves to actually remove material accumulating in the guide channel or passage containing the chain. Normally, two such coupling devices would run in the guide channel and would connect the ends of the drive chain to the machine. The devices would be symmetrical but in mirror image with their shaped regions directed outwardly from the machine. In this way, material can be swept out of the channel continuously as the chain is driven back and forth.

The material cleaned by the passage of a coupling device in accordance with the invention can pass out of the channel via its usual access slot and preferably the coupling device also has a lateral projection engaging in this slot. The projection may have an inclined face co-operating with the aforementioned shaped region and serving to guide the material swept up by the shaped region out of the guide channel and slot.

The shackle means or drawbar which connects to the machine may be rigidly connected to the casing of the coupling device so the casing runs in the guide channel in a non-rotatable manner. In contrast, the other shackle means or drawbar which connects to the chain would then be pivotably supported in the casing to permit the chain to untwist and adjust itself as desired.

To prevent fine dust from entering the slot from above and finding its way behind the shaped region of the device, it is preferable to provide the lateral projection with a built-up raised portion, integral or otherwise, projecting up from the slot and adjacent the exterior face of the guide.

It is desirable to construct the casing of the device from inner and outer sleeves or members since this enables easy replacement of the outer member which is subjected to the greatest wear. The inner member, which can then support both the rigid and swivelling shackle means, can then be re-used. Moreover, the multi-part construction facilitates the replacement of known coupling devices with coupling devices made in accordance with the invention.

In a preferred embodiment of the invention, the coupling device comprises an outer sleeve containing an inner sleeve, the sleeves being coaxial and located axially by means of shoulders formed on their respective inner and outer surfaces, a lateral projection provided on the outer sleeve, the projection having a guide face inclined in relation to the common axis of the sleeves and drawbars connected to the inner sleeve, one drawbar being rigidly connected to the inner sleeve while the other drawbar is pivotably connected to the inner sleeve, the pivotable drawbar serving to connect to a drive chain while the rigid drawbar serves to connect to the machine, wherein at least the outer sleeve has an outwardly-facing shaped region which is directed towards the chain and serves as a cleaning means in use.

The invention may be understood more readily, and various other aspects and features of the invention may become apparent, from consideration of the following description.

BRIEF DESCRIPTION OF THE DRAWINGS

An embodiment of the invention will now be described, by way of example only, with reference to the accompanying drawing, wherein.

DESCRIPTION OF PREFERRED EMBODIMENT

Figure 1:
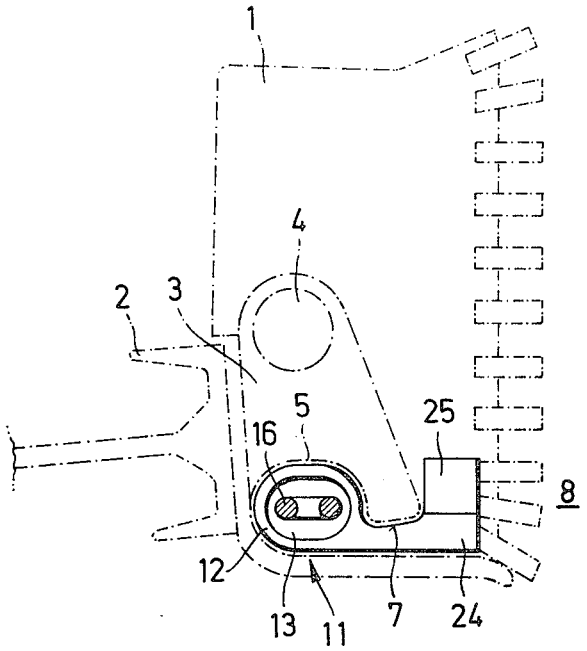
FIG. 1 is a schematic representation of part of a mineral mining installation utilizing a coupling device constructed in accordance with the invention, the coupling device thereof being shown partly in cross-section taken along the line I—I of FIG. 2.
Figure 2:
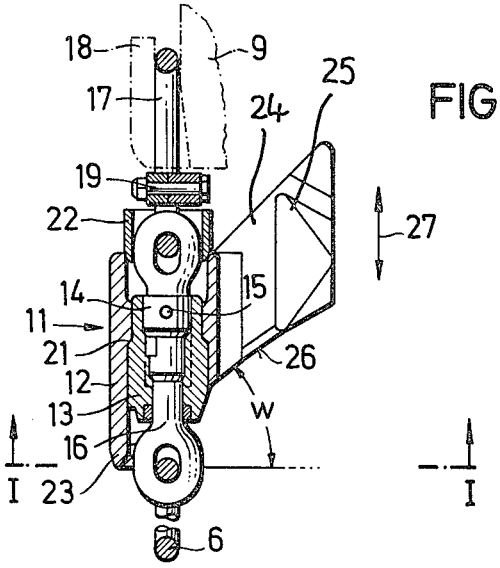
FIG. 2 is a sectional view of the coupling device constructed in accordance with the invention.

FIG. 1 depicts part of a mineral mining installation, particularly for coal winning, wherein a plough is represented by chain-dotted lines 1. The plough 1 is slidably mounted on a guide 3 at the mineral-face side of a longwall conveyor 2. As is known, the plough 1 is moved back and forth along the guide 3 to strip mineral, e.g. coal, from a mineral face 8. A drive chain serves to displace the plough 1 along the guide 3. The chain, denoted 6 in FIG. 2, is arranged within upper and lower guide passages or channels 4,5 respectively, formed in the guide 3. The lower guide channel 5 opens towards the plough 1 and the mineral face 8 via a base slot 7 in the guide 3. The plough 1 has two arms or the like (not visible in the drawing) at or near its ends. These arms extend through the slot 7 into the channel 5. These arms are in turn provided with guide blocks shaped to locate in guiding fashion in the channel 5. One of these guide blocks is shown schematically in FIG. 2 and denoted 9. Each of the guide blocks 9 is secured to the drive chain 6 by way of a coupling device 11 constructed in accordance with the invention. Although only one coupling device 11 is depicted in FIG. 2, the devices 11 are symmetrical and in mirror image to one another.

Referring now to FIG. 2, illustrating one of the coupling devices 11, it can be seen that the device comprises an exterior sleeve or tubular member 12 containing a coaxial interior sleeve or tubular member 13. The members 12,13 are located to one another by means of a shoulder 21 on the internal bore of the member 12 and the exterior of the member 13. A shackle or drawbar 14 is rigidly affixed to the interior member 13 at one end of the latter by means of a cross bolt or pin 15. A further shackle or drawbar 16 is rotatably connected to the other end of the member 13 but prevented from moving axially thereof. The rigid drawbar 14 is connected to the associated one of the guide blocks 9 by means of an eye or link 17 engaging in a hook-shaped region 18 of the guide block 9. A releasable safety clamp 19 ensures that the link 17 cannot become accidentally disengaged from the guide block 9. The member 13 is held within the member 12 with the shoulders 21 abutting by means of a locking ring 22 which locates around the head of the drawbar 14 and the link 17. The ring 22 fits partly inside the member 12. The drawbar 16 is connected to an end link of the chain 6 while the drawbar 16 of the other coupling device 11 connected to the other guide block 9 is similarly connected to an end link of the chain 6.

The end region of each coupling device 11 remote from the plough 1 (the lower end of FIG. 2) is shaped e.g. bevelled, by removing part of the outer member 12. In this way, an outwardly facing cleaning nose 23 is created. The end region of the member 12 defining the nose 23 can also be externally chamfered as shown in FIG. 2. Although in FIG. 2 the inner member 13 is not relieved and bevelled to conform with the member 12, it is possible to provide a similar bevel or member 13 matching that on the outer member 12. The outer member 12 of each coupling device 11 is also provided with a lateral projection 24, integral or otherwise, which engages in the slot 7. A further built-up attachment 25 is fitted to the upper face of the projection 24 or, alternatively, the projection 24 can be shaped to provide an integral equivalent to the attachment 25. The attachment 25 however formed locates adjacent the exterior of the guide 3 and rises up beyond the slot 7 as shown in FIG. 1. As shown in FIG. 2, the projection 24 has an inclined face 26 which merges with the bevelled or shaped region 23 of the member 12 and extends at an angle 'W' relative to a plane passing through the end of the tubular member 12 and defining the section line I—I.

As the plough 1 is driven back and forth along the guide 3 in the directions indicated by arrows 27 in FIG. 2, the coupling devices 11 connecting the chain 6 to the plough guide blocks 9 move along the channel 5 and, by virtue of the projections 24, along the slot 7. Any material, especially fine coal dust which collects in the guide 5 will tend to be swept out by the noses 23 of the devices 11 moving in advance of the plough 1. The noses 23 also tend to strip dust adhering to the wall of the channel 5 in a wedging action. Dust removed from the channel 5 in the manner is guided away over the faces 26 of the projections 24 to fall onto the floor of the working. The projections 24 themselves also remove material from the slot 7 and the projections 24 with their attachments 25 prevent coal dust from entering the channel 5 from above and accumulating behind the devices 11 after the passage of the noses 23, thereby precluding the obstruction of the guide blocks 9 following up behind devices 11.

We claim:

1. In or for a mineral mining installation comprising a winning machine movable back and forth along a guide means of a drive chain located in a guide channel in the guide, said guide being arranged on the mineral face side of a longwall conveyor and having a slot leading from said guide channel and opening towards the mineral face, an improved coupling device for connecting the drive chain to the machine, comprising: a casing provided with shackle means for connection both to the machine and to the chain to allow swivelling motion therebetween, a lateral projection on the casing extending through said slot towards the mineral face, and a shaped region forming a nose at the end of the device adjacent the chain which cooperates with said lateral projection to remove material accumulating in the guide channel out through said slot.

2. A device according to claim 1, wherein the projection has an inclined face which co-operates with the shaped region and guides material away from the guide channel and slot.

3. A device according to claim 2, wherein the projection has a raised portion extending upwardly from the slot and adjacent the exterior of the guide.

4. A device according to claim 3, wherein the raised portion is an attachment to the projection.

5. A device according to claim 1, wherein the casing is composed of inner and outer tubular members.

6. A device according to claim 1, wherein the shackle means for connection to the machine is connected in a rigid manner to the casing while the shackle means for connection to the chain is connected to the casing for swivelling.

7. A device according to claim 6, wherein the casing is composed of inner and outer sleeves located against one another with shoulders and the shackle means for connection to the machine is fixed to the inner sleeve.

8. A device according to claim 7, wherein the shackle means for connection to the chain is rotatably supported by the inner sleeve.

9. A device according to claim 7, wherein a locking ring engages around the shackle means for connection to the machine and serves with the shoulders to maintain the sleeves together.

10. A device according to claim 1, wherein the shackle means for connection to the machine is connected to a guide block of the machine, which runs in the guide channel, via a link fitted with a safety clamp preventing accidental disconnection from the guide block.

11. An installation according to claim 1, wherein there are two such coupling devices connecting the drive chain to each of two guide blocks of the machine which run in the guide channel.

12. A coupling device for connecting a drive chain to a mineral mining machine; said coupling device comprising an outer sleeve containing an inner sleeve, the sleeves being coaxial and located axially by means of shoulders formed on their respective inner and outer surfaces, a lateral projection provided on the outer sleeve, the projection having a guide face inclined in relation to the common axis of the sleeves and drawbars connected to the inner sleeve, one drawbar being rigidly connected to the inner sleeve while the other drawbar is pivotably connected to the inner sleeve, the pivotable drawbar serving to connect to a drive chain while the rigid drawbar serves to connect to the machine, wherein at least the outer sleeve has an outwardly-facing shaped region which is directed towards the chain and serves as a cleaning means in use.

* * * * *